US008943980B2

(12) United States Patent
Moberg

(10) Patent No.: US 8,943,980 B2
(45) Date of Patent: Feb. 3, 2015

(54) ADAPTOR PALLET AND METHOD OF HANDLING CARGO

(75) Inventor: Carsten Moberg, Breuderup (FI)

(73) Assignee: K.Hartwall Oy AB, Soderkulla (FI)

( * ) Notice: Subject to any disclaimer, the term of this patent is extended or adjusted under 35 U.S.C. 154(b) by 944 days.

(21) Appl. No.: 12/863,392

(22) PCT Filed: Jan. 16, 2009

(86) PCT No.: PCT/FI2009/050035

§ 371 (c)(1),
(2), (4) Date: Jul. 16, 2010

(87) PCT Pub. No.: WO2009/090309

PCT Pub. Date: Jul. 23, 2009

(65) Prior Publication Data

US 2010/0310352 A1 Dec. 9, 2010

(30) Foreign Application Priority Data

Jan. 18, 2008 (FI) ..... 20085044

(51) Int. Cl.
*B65D 19/38* (2006.01)
*B65D 19/44* (2006.01)
*B65D 19/00* (2006.01)

(52) U.S. Cl.
CPC ..... *B65D 19/44* (2013.01); *B65D 19/0048* (2013.01); *B65D 2519/00024* (2013.01); *B65D 2519/00059* (2013.01); *B65D 2519/00129* (2013.01); *B65D 2519/00273* (2013.01); *B65D 2519/00293* (2013.01); *B65D 2519/00323* (2013.01); *B65D 2519/00333* (2013.01);

(Continued)

(58) Field of Classification Search
USPC ..... 414/679, 288, 293, 222.03, 222.04, 414/222.05, 222.06, 222.13, 222.07, 414/226.04, 234, 409, 475, 477, 479, 491, 414/509, 522, 536, 558; 108/11, 12, 57.15, 108/57.17, 57.21, 57.31, 97, 102, 180, 189, 108/143, 137; 16/231; 105/395; 109/30; 296/6
See application file for complete search history.

(56) References Cited

U.S. PATENT DOCUMENTS 2,804,218 A * 8/1957 Sylvester et al. ..... 414/282
3,357,582 A * 12/1967 Wittek ..... 414/495
3,561,620 A * 2/1971 Willis ..... 414/282

(Continued)

FOREIGN PATENT DOCUMENTS

DE 202004017634 U1 2/2005
DE 202006007202 U1 8/2006

(Continued)

*Primary Examiner* — Saul Rodriguez
*Assistant Examiner* — Glenn Myers
(74) *Attorney, Agent, or Firm* — Birch, Stewart, Kolasch & Birch, LLP

(57) ABSTRACT

An adaptor pallet (10) which comprises at least one load bearing deck (12) to receive the wheels (22) of a dolly (20), the load bearing decks (12) that are separated by at least one lifting point (18) to receive the lifting forks of a forklift as well as at least one locking member (16) to engage with the dolly (20) the locking member (16) being adapted to be manipulated with activation means. The activation means comprises at least a lever (14) and it is adapted to deactivate said locking member (16) when it is moved in its first degree of freedom. Also the activation means is adapted to activate said locking member (16) when it is moved in its second degree of freedom. A method of handling cargo.

20 Claims, 5 Drawing Sheets

(52) U.S. Cl.
CPC ..... *B65D2519/00572* (2013.01); *B65D 2519/00815* (2013.01)
USPC ..... 108/57.15; 108/11

(56) References Cited

U.S. PATENT DOCUMENTS 3,768,673 A * 10/1973 Nydam et al. ..... 414/522
3,854,616 A * 12/1974 Willis et al. ..... 414/607
4,307,985 A * 12/1981 Desprez et al. ..... 410/46
4,802,421 A * 2/1989 Atterby et al. ..... 108/57.17
4,950,123 A * 8/1990 Brockhaus ..... 414/522
5,046,913 A * 9/1991 Domek et al. ..... 414/522
5,529,378 A 6/1996 Chaban et al.
5,720,489 A * 2/1998 Pierce et al. ..... 280/149.2
6,263,806 B1 * 7/2001 Heil ..... 108/55.3
6,592,322 B2 * 7/2003 Yang et al. ..... 414/663
6,676,120 B1 * 1/2004 Hallbeck et al. ..... 269/6
7,219,609 B1 * 5/2007 Utz et al. ..... 108/57.21

FOREIGN PATENT DOCUMENTS

FR 2757829 A1 7/1998
GB 2416527 A 2/2006
SE 463023 B 10/1990

* cited by examiner

ADAPTOR PALLET AND METHOD OF HANDLING CARGO

FIELD OF THE INVENTION

The present invention relates to an adaptor pallet for transporting and storing a plurality of wheeled dollies.

BACKGROUND OF THE INVENTION

Goods of relatively small size are typically transported using wheeled dollies, which are usually platforms, which are mounted on wheels or castors. The goods are stored in containers that are prismatic and whose shape fits into the receptive platform. Upon transportation or temporary storage, the boxlike containers are stacked onto a dolly whose wheels enable easy handling by hand. The shape and size of the dollies are usually standardized to conform advantageously to industrial container models.

While the dollies may be moved about by hand, there is also a need to transport a plurality of dollies at once. Such need would occur e.g. when loading or unloading a trailer or a lorry. If a trailer is loaded dolly by dolly, the long duration of the operation consumes valuable docking time not to mention inflicted gratuitous vehicle idle time. Also, when transported individually, the dollies require thorough and tedious trussing up to prevent unintended movement within the load space. To tackle these disadvantages, adaptor pallets have been developed to aggregate a plurality of dollies carrying piles of containers. These adaptor pallets are usually rather flat and include a deck that has an upper support surface to accommodate a plurality of wheeled dollies, gouges to guide the dolly wheels, means for supporting the deck a certain distance above ground, receptive slots to receive the lifting forks of a forklift, an inclined surface to act as a ramp onto the deck and means for securing the dollies into the adaptor pallet. Such pallets have been extensively described in publication GB2416527.

However, the current adaptor pallets have considerable disadvantages. A major disadvantage is that adaptor pallets on the market are burdensome, tardy and not especially ergonomic to operate. For example, the construction presented in publication GB2416527 introduces a locking mechanism requiring that the operator swivels two ramp members in order to ensure that the dollies are sufficiently stationary during transport.

There are also other types of locking mechanisms. The most progressive ones utilize locking members which, rather than preventing the movement of the wheels, grab hold to the body of the dolly thus preventing its movement relative to the pallet. Until now they too have been inconvenient to operate due to the shortcomings of their locking mechanisms that will not enable effortless loading sequences. The problem in these types of locking mechanisms can be tracked down to the locking members, which may not be deactivated properly so that the dollies could be loaded on to the pallet. Even with the most favourable adaptor pallets, the operator must release the dolly from each of the previous locking positions when propelling the dolly to its farthermost locking position. This is obviously a considerable disadvantage that results in wasted work effort and inconvenience. The discomfort of the operator may be further elevated by locking mechanisms that are difficult to negotiate combined with the load of the heavy dolly. In addition, previous pallet models were unsuitable to be stored stacked on top of each other when empty due to the shortcomings of their locking mechanisms, which would occasionally break from the weight of the other pallets.

It is an object of the present invention to provide an improved product to tackle at least some aforementioned disadvantages by introducing an evolved adapter pallet construction.

SUMMARY OF THE INVENTION

The invention is based on a new type of locking mechanism that includes fully independent locking members, which may be deactivated with a lever, which may be operated without having to let go of the dolly. Furthermore, the present invention introduces activation means, which may easily be operated by manipulating a two-dimensional regulator by foot.

More specifically, the apparatus according to the invention is characterized by what is stated in the independent claims.

Considerable advantages are gained with the aid of the invention.

The operator is able to load the adaptor pallet without the unsolicited interference of activated locking members. Also, the locking mechanism may be operated by foot leaving both hands available to handle cargo. The opportunity to secure and release the dollies fluently by foot assuages the burdensome task of negotiating intricate fastening ramp members while supporting a heavily loaded dolly. There are improvements to known locking systems as well; the locking members may be deactivated separately by pressing them downward and the lever that manipulates them remains flat and not disruptive when not specifically turned. Furthermore, because of the advanced locking mechanism along with its lever, empty adaptor pallets are now suitable to be stored stacked on top of each other. Since the lever of the adaptor pallet remains in a horizontal position when not specifically pressed down, the pallets are easy to stack without damaging the lever or other parts of the locking system with the forks of a forklift, as would be the case with conventional pallets. If the locking members would not be independently suspended in relation to their axle, the weight of the other pallets would apply pressure to the locking members resulting in damages in the locking members themselves as well as the lever and other parts that are connected to the locking member. Also, it is important that the lifting points of the pallet remain accessible regardless of the weight on top of the pallet, so that e.g. the lever will not be damaged by for the lifting forks of a forklift. In addition to easy storage, the present pallet type is advantageous due to the ability to conform with known pallet standards. The design of the pallet allows the structure to stay within the usual standardized pallet dimensions, such as EUR-pallets (1200 mm*800 mm) and industrial pallets (1200 mm*1000 mm and 1200 mm*1200 mm).

As mentioned, the lever may be operated by foot, which enables the operator to deactivate the locking members and remove his foot from danger zone before rolling out the dollies. This is a significant reformation to occupational safety, because it mitigates the risk of foot and leg injuries. Furthermore, the fully independent locking members, which fasten the dollies to the pallet, may be deactivated independently by pressing them downward. This feature makes the structure flexible to use, since empty dolly positions may be occupied while other locking members are active.

BRIEF DESCRIPTION OF THE DRAWINGS

Some embodiments of the present invention shall now be described in detail with reference to the accompanying drawings, in which.

DETAILED DESCRIPTION OF THE PREFERRED EMBODIMENTS

Figure 1:
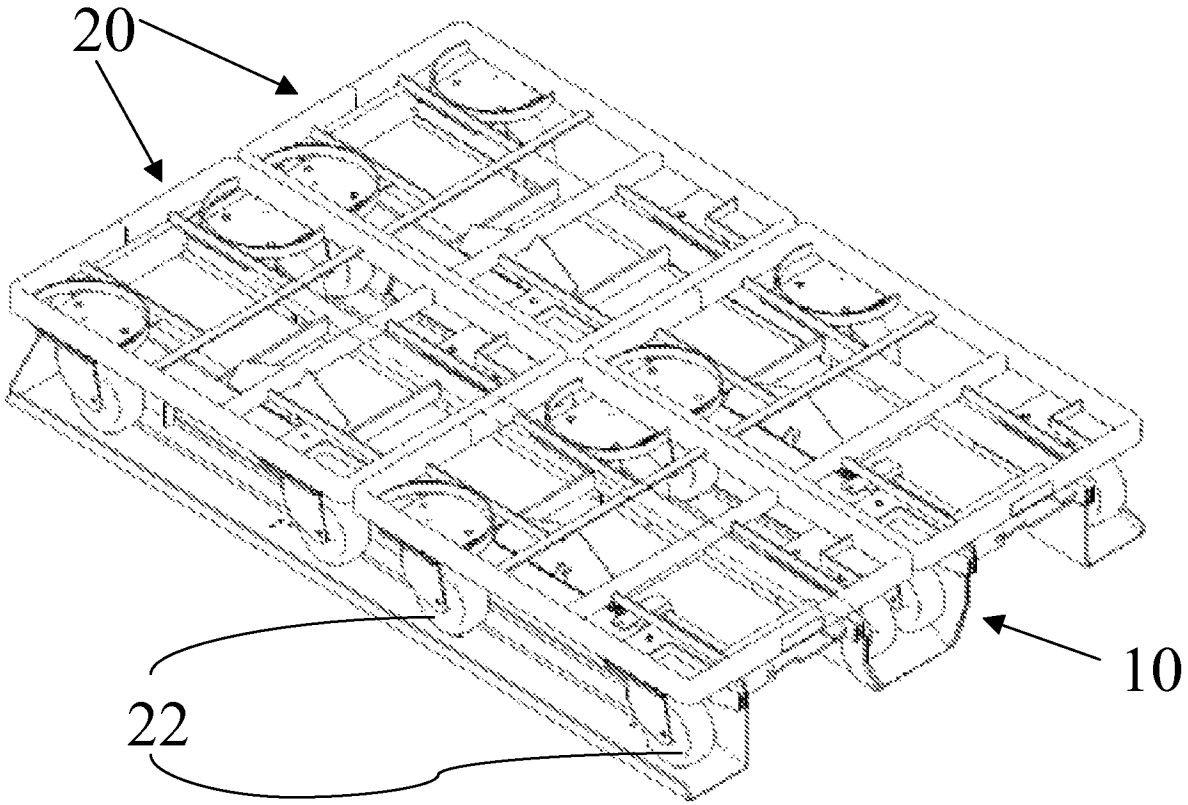
FIG. 1 shows an isometric view of an adaptor pallet loaded with four dollies.

As illustrated in FIG. 1, according to one embodiment of the present invention, the adaptor pallet 10 is adapted to receive four dollies 20 in two rows, both incorporating two dollies 20. Each dolly 20 includes four wheels 22, which are located underneath its body. Dollies 20 are loaded onto adaptor pallet 10 by propelling them on their wheels 22 by hand.

Figure 2:
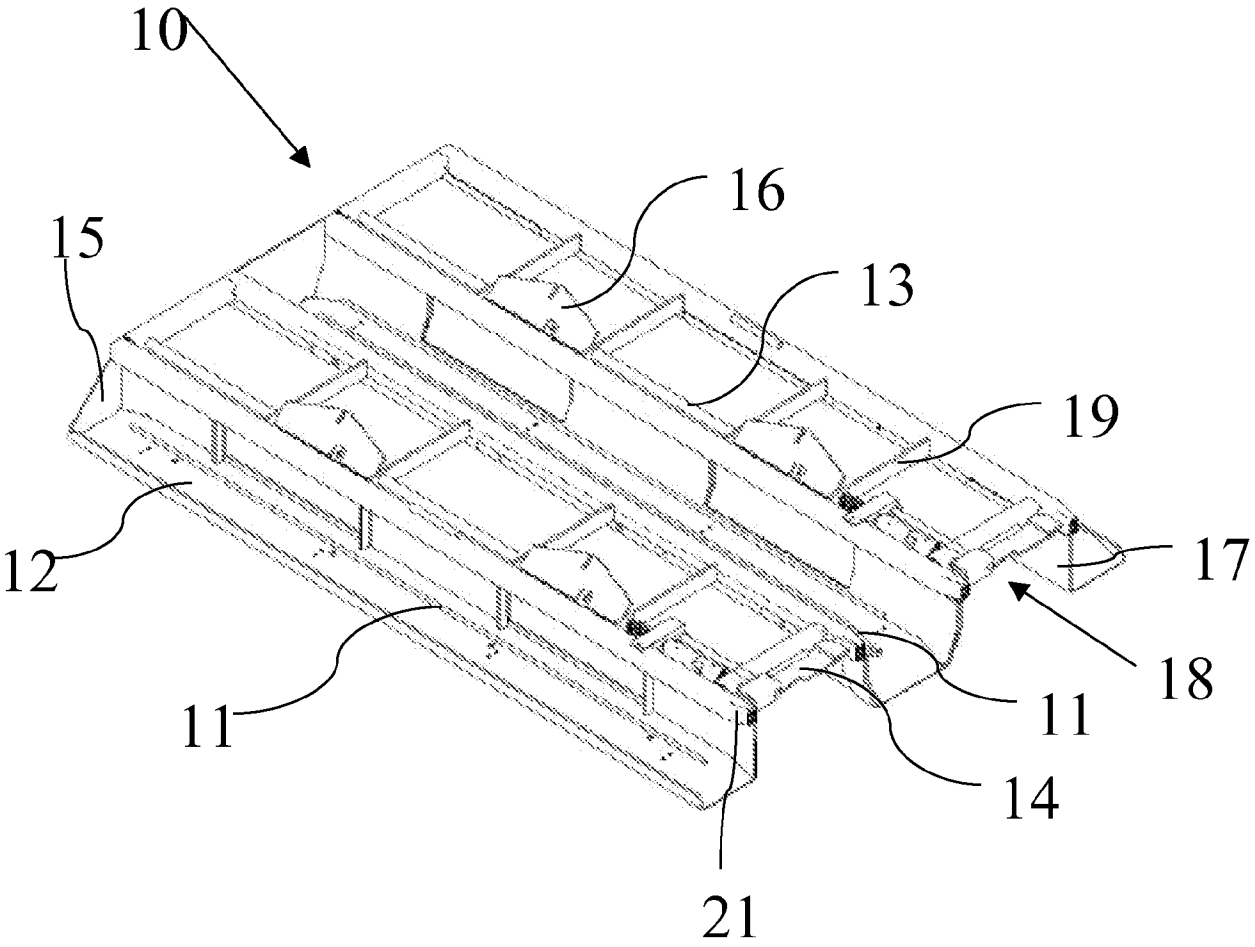
FIG. 2 shows an isometric view of an empty adaptor pallet with activated locking members.

As illustrated in FIG. 2, adaptor pallet 10 has three load bearing decks 12, the middle one of which is essentially twice as wide as the other two located at the side ends of adaptor pallet 10. Load bearing decks 12 at the side ends of adaptor pallet 10 have vertical edgings at their outer ends. Each load bearing deck 12 has a gable wall 15, which is advantageously at least half as lofty as wheel 22. Gable walls 15 are located at either end of adaptor pallet 10 leaving the other end open for the loading of dollies 20. This end shall be referred to as the loading side of adaptor pallet 10. However, according to other embodiments of the present invention, both ends of adaptor pallet 10 may also be left open without said gable wall 15 allowing a run-through structure. Load bearing decks 12 have guide rails 11, which extend longitudinally from the loading side to gable wall 15. The distance between the vertical edging at the outer end of load bearing deck 12 and guide rail 11 is at least the width of wheel 22. The load bearing deck 12 in the middle of adaptor pallet 10 has its guide rail 11 in the middle of its upper face so that it is able to accommodate wheels 22 of dolly 20. Furthermore said guide rail 11 is wedge-shaped at the open end of the middle load bearing deck 12 and wide enough to separate the exceeding of the bodies of dollies 20. Generally speaking, the distance between the inner walls 17 is as narrow as possible in order to optimize adaptor pallet 10 for automatic storage facilities and standard handling equipment. On the other hand, lifting points 18 should be wide enough to accommodate as wide a spectrum of handling equipment as possible.

Load bearing decks 12 are separated by lifting points 18, which are elevated from the ground by walls 17. Lifting points 18 essentially as wide as the track of dollies 20, but at least wider than standard sized lifting forks of ordinary forklifts. Walls 17 therefore rise from load bearing decks 12 and are essentially as high as the ground clearance of dollies 20. Walls 17 are equipped with guide bars 21 which are located at the upper end of walls 17 and which are wedge-shaped at their free end. Adjacent walls 17 are connected by torsion bars 19 which add rigidity to the construction and engage with the lifting forks of the forklift. Both lifting points 18 include a lever 14, which is connected to two locking members 16 via an axle 13.

Figure 5:
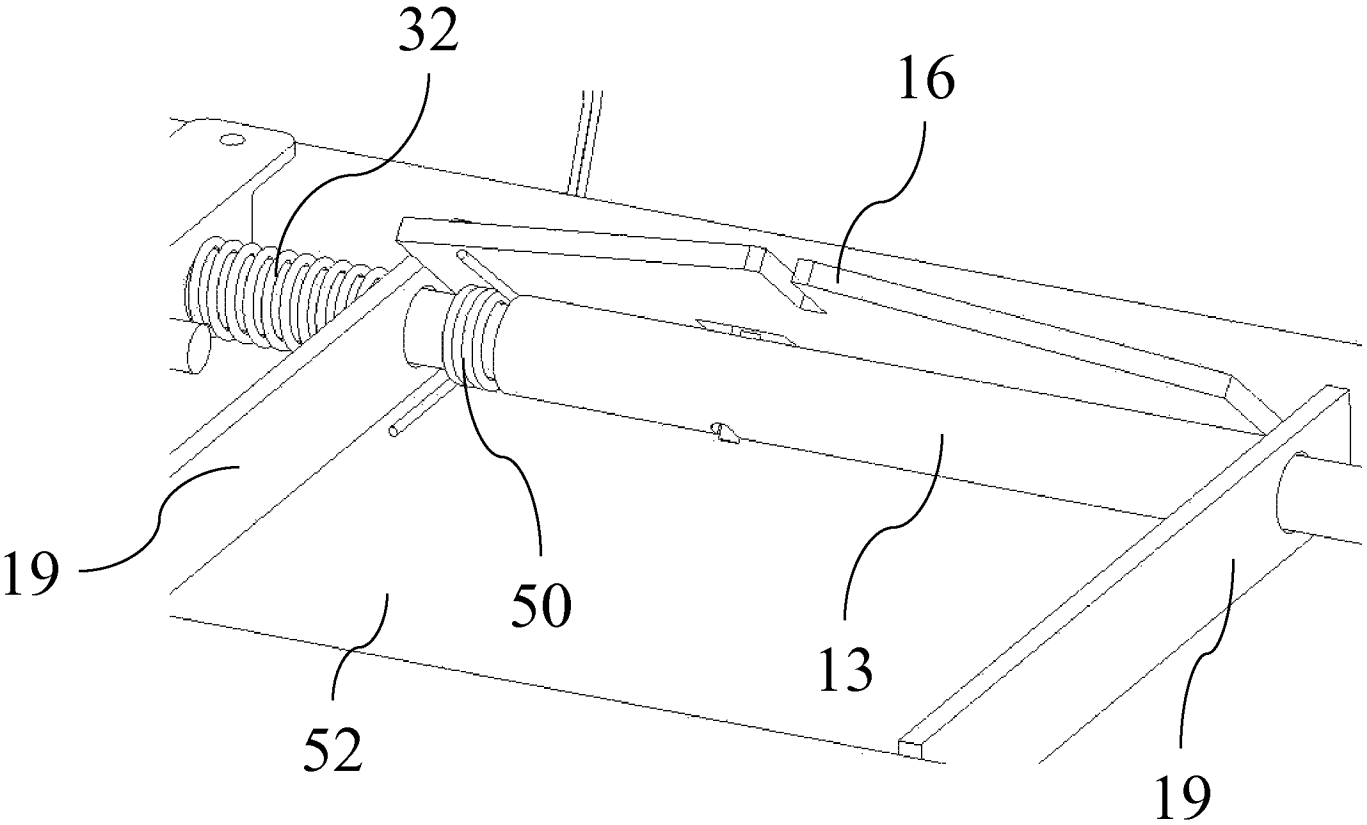
FIG. 5 shows an isometric detail view of the locking member of an adaptor pallet.

As illustrated in FIG. 5, locking member 16 is suspended in relation to axle 13 with spring 50 to allow elasticity between the two parts. Spring 50 has a coil-like structure with two pins protruding out of the suspending coil. One of the pins is fixed to locking member 16 and the other is fixed to plate 52 connecting torsion bars 19. The suspension is construed so that, locking member 16 may be bent down as it would when rotating axle 13 clockwise. This way, upon loading adaptor pallet 10, locking member 16 is able to conform to the body of dolly 20 with its inclined shape until its slot engages with the corresponding part of dolly 20. The suspension is essential to one embodiment of the present invention, as it enables dolly 20 to be loaded onto the first row adaptor pallet 10 without deactivating locking member 16.

Figure 3:
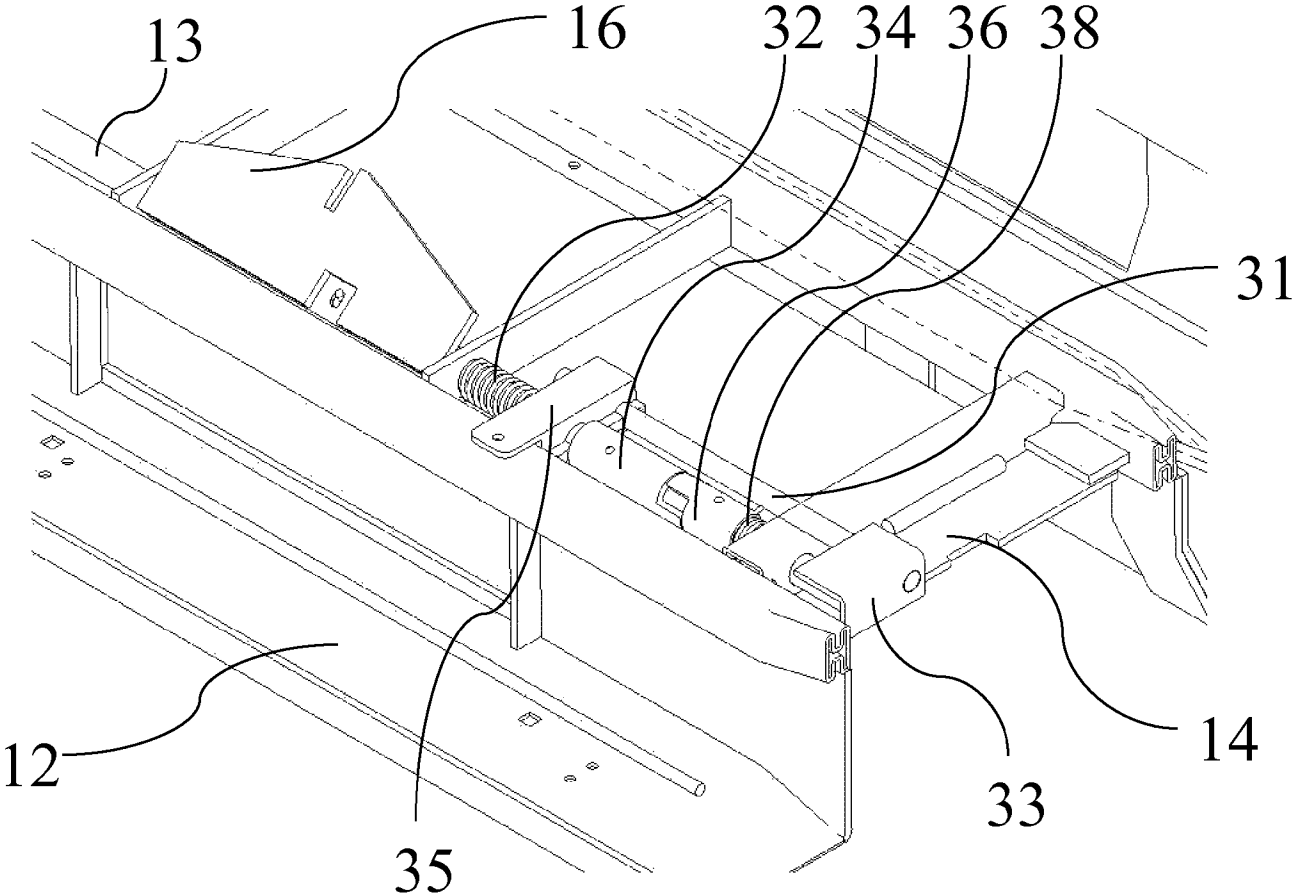
FIG. 3 shows an isometric detail view of the locking system of an adaptor pallet.

As illustrated in FIG. 3, lever 14 is located between torsion bars 19 at their wedge-shaped end. Lever 14 is adapted to move axle 13, to which locking members 16 are attached. Lever 14 is also adapted to be moved rotationally. The rotational movement, which is from here on referred to as the first degree of freedom of activation means, is clockwise rotation about axle 13, which rotation may extend up to 90 degrees. Activations means in this context refers to the entity that attends to the activation and deactivation of locking member 16, e.g. lever 14, release rod 31 and axle 13. The linear movement, which is from here on referred to as the second degree of freedom of activation means, is movement in the direction of axle 13. It should thus be noted that although the second degree of freedom of activation means is indeed linear, lever 14 is not moved linearly according to this specific embodiment of the present invention.

The locking system further comprises means for deactivating locking member 16 and releasing it to its activated, upright position. Connected to lever 14 via axle 13 is primary sleeve 36, which is fitted with constrainer 38, which is a spring that is wound around axle 13. It is appropriate to note that axle 13 is not continuous; it extends from lever 14 to the second locking member 16, but there is a gap between primary sleeve 36 and secondary sleeve 34. In other words axle 13 is a member of activation means connecting the essentially functional parts. Constrainer 38 has a coil-like structure with two pins, one of which is fixed to wall 17 and the other is fixed to primary sleeve 36 thus constraining it to a preferred position in relation to lever 14. This position remains constant at all times, which means that when rotated, lever 14 is adapted to return to its original position. Primary sleeve 36 is also fitted to axle 13 and it engages with secondary sleeve 34 like a jaw clutch. There is a gap between the coupling edges of primary sleeve 36 and secondary sleeve 34 when locking member is in its activated position. Secondary sleeve 34 further delivers the rotation to locking members 16 through axle 13. Axle 13 is equipped with compression member 32 between secondary sleeve 34 and torsion bar 19. Compression member 32 enables axial elasticity of restraint bar 35 when retracted from primary sleeve 36 by restraint bar 35. Compression member 32 is restrained by restraint bar 35, which is supported by release rod 31. Release rod 31 is fixed between restraint bar 35 and the torsion bar 19 nearest to lever 14. The other end of release rod 31 is connected to release angle 33, whose horizontal portion is above lever 14 and whose vertical portion covers the front end of lever 14. Accordingly, when executing movement in the second degree of freedom of activation means, release angle 33 is actually pushed in delivering the movement to restraint bar 35.

Figure 4:
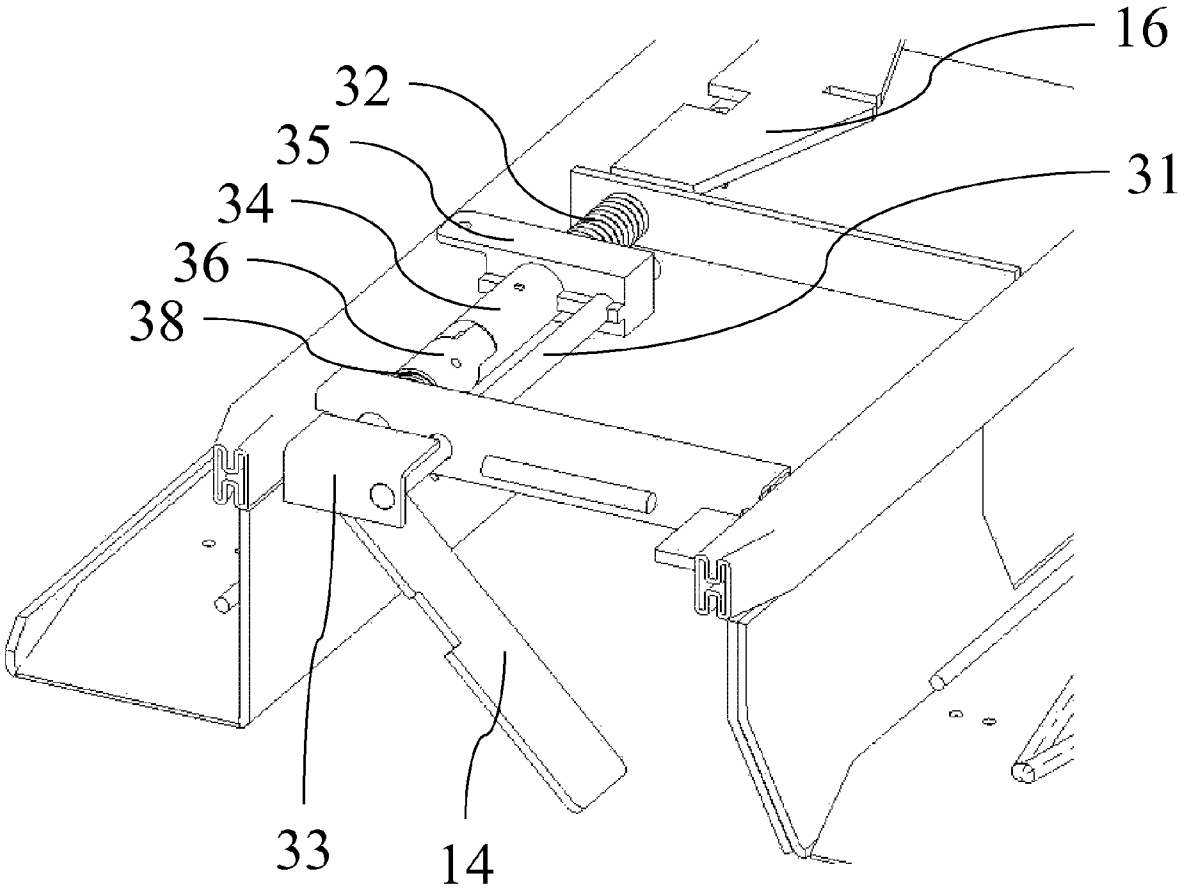
FIG. 4 shows an isometric detail view of the locking system illustrated in FIG. 3 when the lever is its downright position.

As illustrated in FIG. 4, when lever 14 is rotated to its farthest position, axle 13 has delivered the rotation to locking member 16. Also, the rotation has made primary sleeve 36 and secondary sleeve 34 interact, which together with the tension of compression member 32 has retracted restraint bar 35 thus moving release rod 31 towards the loading side of adaptor pallet 10. Secondary sleeve 34 has revolved clockwise into its locked position thus imposing its position on axle 13 and locking member 16. Secondary sleeve 34 is adapted to assume a locked position with the aid of a groove, which engages with a corresponding protruding member in restraint bar 35. The locking groove in secondary sleeve 34 is in an angled position when the locking mechanism is in a deactivated position. However, when lever 14 is rotated in its first degree of freedom, the locking groove in secondary sleeve 34 rotates so that it becomes parallel with the protruding member in restraint bar 35. Restraint bar 35 is then pushed against secondary sleeve 34 and the locking system is secured in a deactivated position. When release rod 31 is moved to the front, release angle 33 is refracted away from lever 14.

When lever 14 is released from the farthest position in its first direction of movement, constrainer 38 returns lever 14 to its original, horizontal position. Now locking member 16 is in its horizontal position and release angle 33 remains retracted from lever 14. The gap between the coupling edges of primary sleeve 36 and secondary sleeve 34 is now closed up. Once release angle 33 is pushed in, the movement is delivered to release rod 31, which moves restraint bar 35 and compresses compression member 32. The movement makes secondary sleeve 34 rotate in relation to primary sleeve 36, which allows axle 13 together with locking member 16 to return to their original positions. The locking groove in secondary sleeve 34 has also retracted from the protruding member in restraint bar 35. Locking member 16 is now activated. It is beneficial to note that axle 13 has now performed a restored radial displacement at its point of discontinuity.

In this context, lifting point 18 refers to—rather than a single point—the whole gap between walls 17. Furthermore in this context, the first and second directions of movement of activation means refer to what is described above, but they may naturally be e.g. opposite directions of the same path according to other embodiments of the present invention.

The loading and unloading of adaptor pallet is described in the following.

When adaptor pallet 10 is empty, it is prepared for loading by deactivating locking members 16 between load bearing decks 12 intended for occupation. Deactivation is done by moving lever 14 to its first direction. The motion is delivered directly to locking member 16, which is then set to deactivated position i.e. horizontally. Once locking members 16 are horizontal, first dollies 20 are loaded onto adaptor pallet 10. To prevent dollies 20 from rolling on load bearing decks 12, they are locked into position by activating locking members 16. This is carried out by moving activation means to its second direction by pushing release angle 33 inwards, which releases locking member 16 from its deactivation position and allows its slot to engage with the body of dolly 20, as illustrated in FIG. 1. Once the first dollies 20 are in place, the next ones may be loaded in a similar manner. However, when loading the last dolly 20 of a certain file, locking member 16 does not have to be deactivated prior rolling dolly 20 onboard. On the contrary, dolly 20 is rolled directly onto adaptor pallet, in which case suspended locking member 16 conforms to the body of dolly 20 with its inclined shape until its slot engages with the corresponding part of dolly 20. Once all dollies 20 are onboard and secured, adaptor pallet 10 is ready for transport. Adaptor pallet 10 is thus ready to be hoisted from lifting points 18 with e.g. the lifting forks of a forklift.

Alternatively, dollies 20 may all be loaded onto adaptor pallet 10 while all locking members 16 are deactivated. This requires that the surface on which adaptor pallet 10 lies is even enough so that dollies 20 do not roll off by themselves. Once all dollies 20 are on board, locking members 16 are activated in a similar fashion as described above.

When adaptor pallet 10 is ready for unloading, dollies 20 onboard are released from their locked positions by deactivating locking members 16 as described above. Once they are in their horizontal position, dollies 20 are free to be rolled off adaptor pallet 10.

The invention claimed is:

1. An adaptor pallet comprising at least two load bearing decks to receive the wheels of a dolly, the at least two load bearing decks being separated by at least one lifting point to receive the lifting forks of a forklift; and at least one locking member to engage with the dolly;

activation means for manipulating the at least one locking member, wherein the activation means comprises at least a lever, and the activation means is configured to be moved in a first degree of freedom and in a second degree of freedom which is different from the first degree of freedom, and wherein said activation means is adapted to deactivate said at least one locking member when moved in its first degree of freedom and adapted to activate said at least one locking member when moved in its second degree of freedom, wherein the lever is adapted to move an axle, to which the at least one locking member is attached, and wherein connected to said at least one locking member is a means for suspending said at least one locking member in relation to said axle, wherein a dolly may be loaded albeit said at least one locking member being activated.

2. The adaptor pallet according to claim 1, wherein said first degree of freedom of said activation means is rotational movement.

3. The adaptor pallet according to claim 2, wherein said rotational movement is about an axle which is configured to be rotated by the lever.

4. The adaptor pallet according to claim 1, wherein said second degree of freedom of said activation means is linear movement.

5. The adaptor pallet according to claim 4, wherein said linear movement is in the axial direction of an axle which is configured to be rotated by the lever.

6. A method of handling cargo by a system comprising at least one dolly and one adaptor pallet of claim 1, comprising the following steps:

propelling at least one dolly onto the adaptor pallet;

deactivating at least one locking member of the adaptor pallet by moving the activation means of said adaptor pallet in its first degree of freedom prior to propelling at least one dolly onto said adaptor pallet; where after at least one dolly is propelled onto said adaptor pallet;

and thereafter activating the at least one locking member by moving the activation means of said adaptor pallet in its second degree of freedom to secure the cargo.

7. The method of handling cargo according to claim 6, further comprising:

moving said activating means in its said first degree of freedom, the movement being rotation about the axle of said at least one locking member, and rotating said axle, said at least one locking member rotates into its deactivated position.

8. The method of handling cargo according to claim 6, wherein said second degree of freedom is movement in the direction of said axle of said at least one locking member.

9. The method of handling cargo according to claim 6, wherein the last dolly is loaded onto said adaptor pallet without moving said activation means.

10. The method of handling cargo according to claim 6, wherein said adaptor pallet is hoisted from it's said at least one lifting point.

11. The method of handling cargo according to claim 6, wherein said adaptor pallet is prepared for unloading by moving said activation means in its second degree of freedom.

12. The adaptor pallet according to claim 1, wherein said first degree of freedom of said activation means is rotational movement.

13. The adaptor pallet according to claim 1, wherein said second degree of freedom of said activation means is linear movement.

14. The adaptor pallet according to claim 2, wherein said second degree of freedom of said activation means is linear movement.

15. The adaptor pallet according to claim 3, wherein said second degree of freedom of said activation means is linear movement.

16. The method of handling cargo according to claim 7, wherein said second degree of freedom is movement in the direction of said axle of said at least one locking member.

17. The method of handling cargo according to claim 7, wherein the last dolly is loaded onto said adaptor pallet without moving said activation means.

18. The method of handling cargo according to claim 8, wherein the last dolly is loaded onto said adaptor pallet without moving said activation means.

19. The method of handling cargo according to claim 7, wherein said adaptor pallet is hoisted from it's said at least one lifting point.

20. An adaptor pallet comprising at least two load bearing decks to receive the wheels of a dolly, the at least two load bearing decks being separated by at least one lifting point to receive the lifting forks of a forklift; and at least one locking member to engage with the dolly;

activation means for manipulating the at least one locking member, wherein the activation means comprises at least a lever, and the activation means is configured to be moved in a first degree of freedom and in a second degree of freedom which is different from the first degree of freedom, and wherein said activation means is adapted to deactivate said at least one locking member when moved in its first degree of freedom and adapted to activate said at least one locking member when moved in its second degree of freedom, and wherein at least one lifting point is elevated from the at least two load bearing decks by walls.

* * * * *